US006516568B2

(12) United States Patent
Yang

(10) Patent No.: US 6,516,568 B2
(45) Date of Patent: Feb. 11, 2003

(54) SAFETY DOOR BARRIER WITH LOCKING HINGE AND AUTOMATIC LATCH

(75) Inventor: Ming-Li Yang, Taipei (TW)

(73) Assignee: Tung Pang Industrial Co., Ltd., Taipei (TW)

( * ) Notice: Subject to any disclaimer, the term of this patent is extended or adjusted under 35 U.S.C. 154(b) by 0 days.

(21) Appl. No.: 09/904,853

(22) Filed: Jul. 16, 2001

(65) Prior Publication Data

US 2003/0005643 A1 Jan. 9, 2003

(30) Foreign Application Priority Data

Jul. 3, 2001 (TW) ..... 90203404 U

(51) Int. Cl.[7] ..... E06B 3/36
(52) U.S. Cl. ..... 49/463; 49/57
(58) Field of Search ..... 49/50, 57, 55, 49/463, 465, 388, 397; 16/331, 332, 334

(56) References Cited

U.S. PATENT DOCUMENTS 1,017,488 A * 2/1912 Zindars ..... 297/64
1,603,408 A * 10/1926 Rickenbacher ..... 16/331
1,687,174 A * 10/1928 Mountford et al. ..... 16/334
5,442,881 A * 8/1995 Asbach et al. ..... 49/465
5,638,885 A * 6/1997 Freese et al. ..... 160/371
5,657,809 A * 8/1997 Longoria et al. ..... 160/369
6,112,461 A * 9/2000 Cheng ..... 49/55
6,301,832 B1 * 10/2001 Andersen ..... 49/57

* cited by examiner

*Primary Examiner*—Gregory J Stimbu
(74) *Attorney, Agent, or Firm*—Troxell Law Office PLLC

(57) ABSTRACT

A safety door barrier includes a barrier post, barrier body, and a barrier stopper. The barrier post has upper and lower seats at the upper and lower ends thereof respectively. The upper seat has an upper stop with an upwardly slanted bottom and a lower stop with a downwardly slanted top. The lower stop has a lower stop hole, and the lower seat has a lower seat hole. The barrier body has an upper projection and a lower projection corresponding to the lower stop and the lower seat respectively, an upper pivot and a lower pivot extending downwardly from the upper and the lower projections respectively corresponding to the lower stop hole and the lower seat hole, and a latch device composed of a latch and a spring disposed at a lateral side of the barrier body opposite to the upper projection. The barrier stopper provides a latch hole corresponding to the latch device. The barrier body can be raised up and pushed forward or backward to open. The latch is inserted into the latch hole to lock the barrier body as soon as the barrier body is back.

3 Claims, 4 Drawing Sheets

SAFETY DOOR BARRIER WITH LOCKING HINGE AND AUTOMATIC LATCH

BACKGROUND OF THE INVENTION

1. Field of the Invention

The present invention relates to a safety door barrier, and, more particularly, to an improvement on a safety door barrier, which can close automatically after being opened forward or backward without swinging back and forth.

2. Description of Related Art

The safety door barrier is usually mounted at a doorframe in a house temporarily to prevent a baby or a pet from entering through the doorway so that it is possible to effectively partition a space.

A conventional safety door barrier provides a lock mechanism between a barrier door and a lateral engaging seat such that the barrier door can engage with the engaging seat for positioning the barrier door. However, the barrier door of the conventional safety door barrier may be opened in one direction only.

In fact, in order to offer the user a convenience, it is not satisfactory for the user that the barrier door is only opened along one direction, that is, the barrier being able to be moved either along one direction or along a reversed direction is required. Moreover, it is tedious that the lock device, i.e., the locating device, for the barrier door is not automatically operated so that the lock device has to be turned whenever the barrier door is closed.

SUMMARY OF THE INVENTION

An object of the present invention is to provide a safety door barrier, in which a barrier body can be opened either forward or backward as soon as the barrier body is lifted and then move back to the closed position automatically as soon as the barrier body is pressed down to prevent from a baby or a pet entering through.

BRIEF DESCRIPTION OF THE DRAWINGS

The present invention can be more fully understood by referencing to the following description and accompanying drawings, in which.

DETAILED DESCRIPTION OF THE PREFERRED EMBODIMENTS

Figure 1:
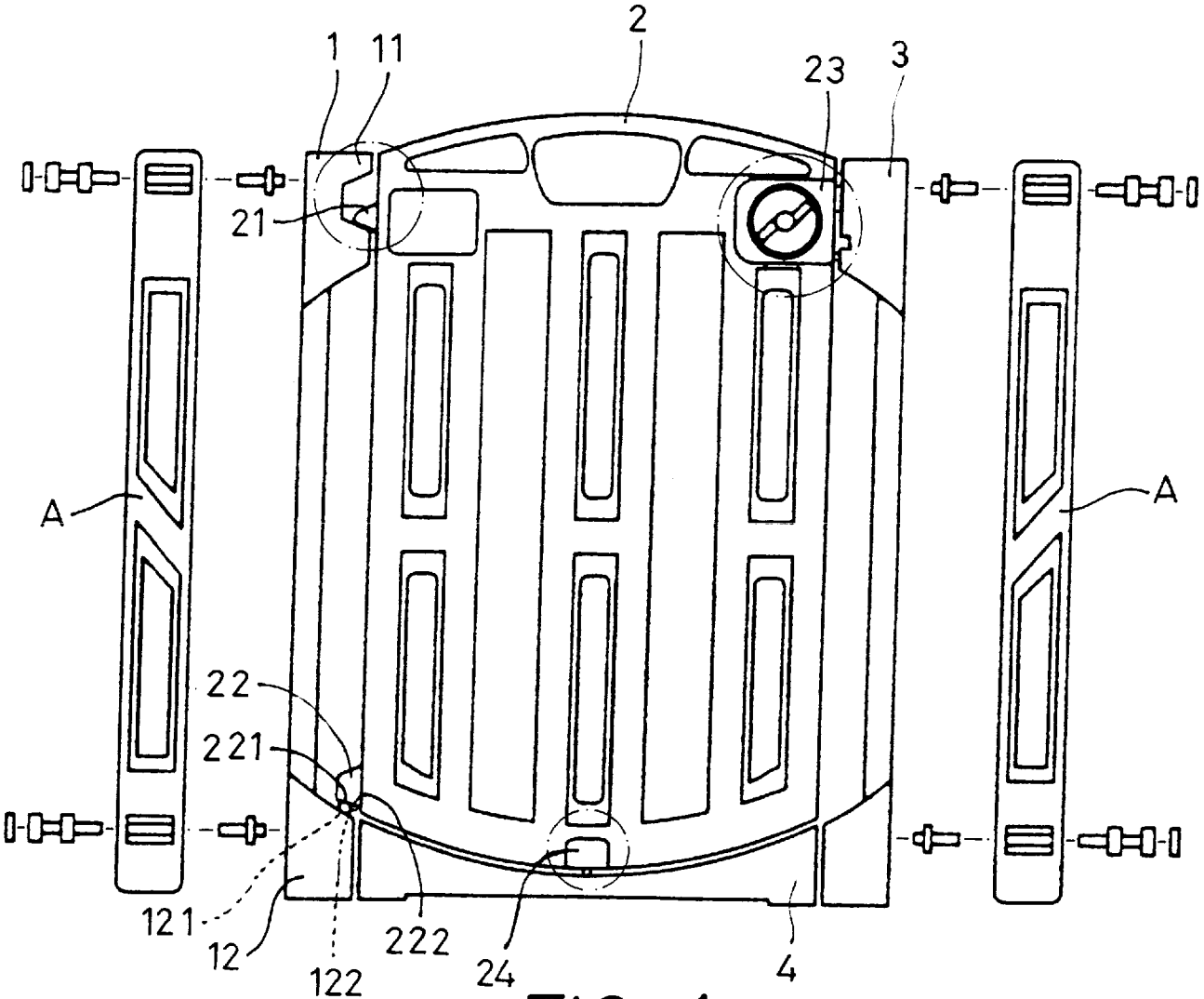
FIG. 1 is a plan view of a safety door barrier according to the present invention.
Figure 2:
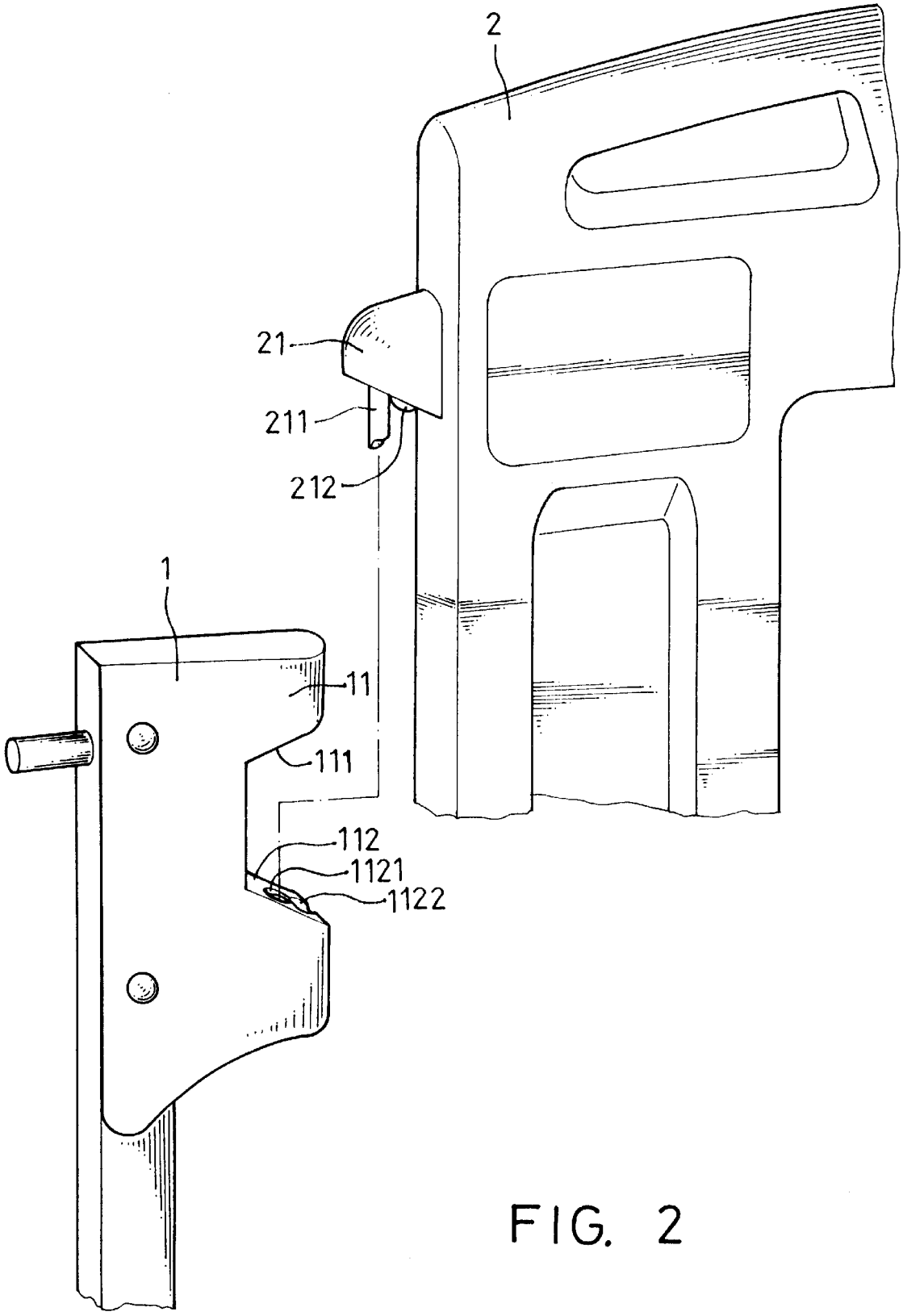
FIG. 2 is a fragmentary perspective view illustrating a barrier body corresponding to a barrier post of the door barrier shown in FIG. 1.
Figure 3:
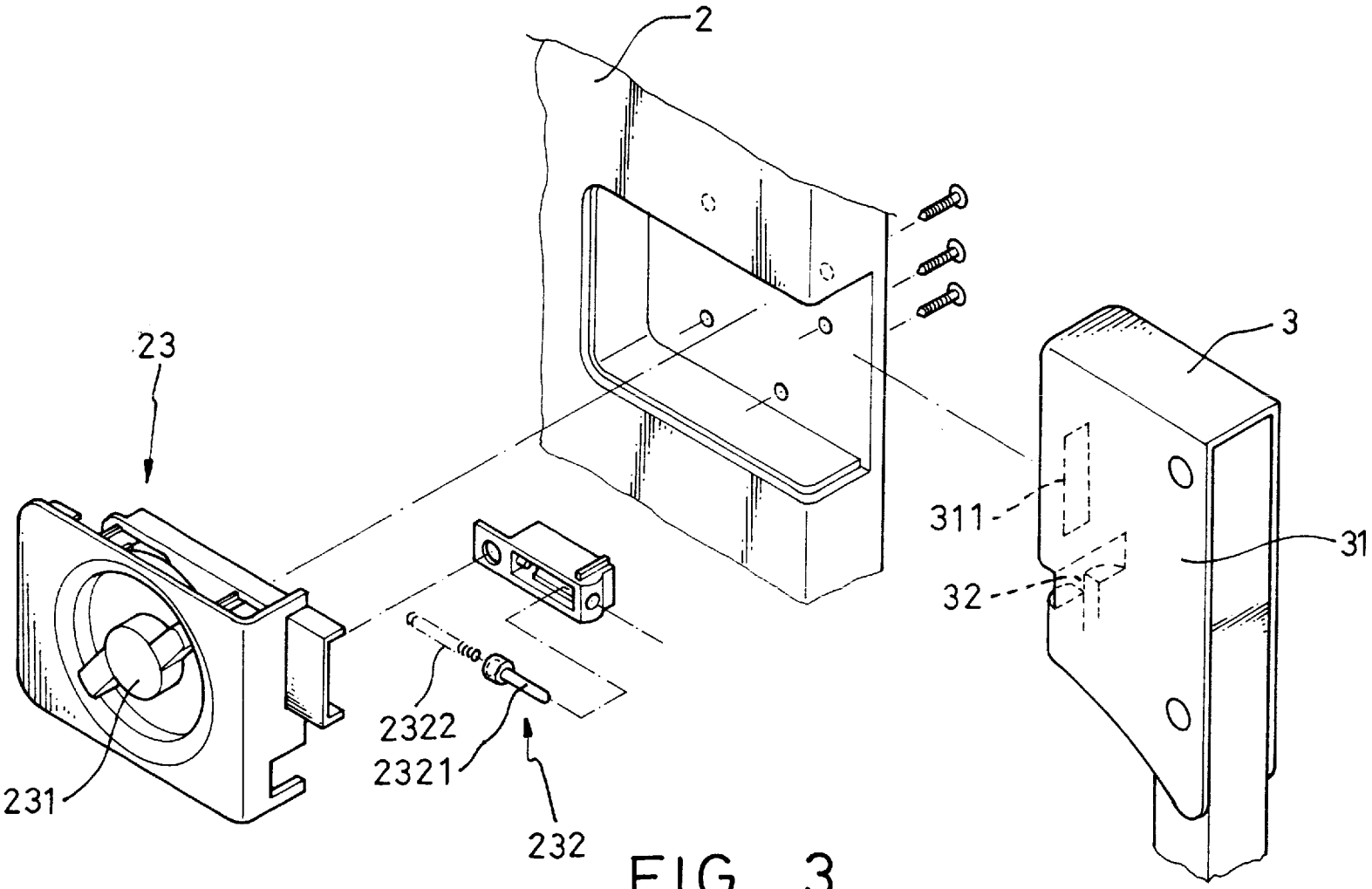
FIG. 3 is a fragmentary perspective view illustrating the barrier body corresponding to a barrier stopper shown in FIG. 1.
Figure 4:
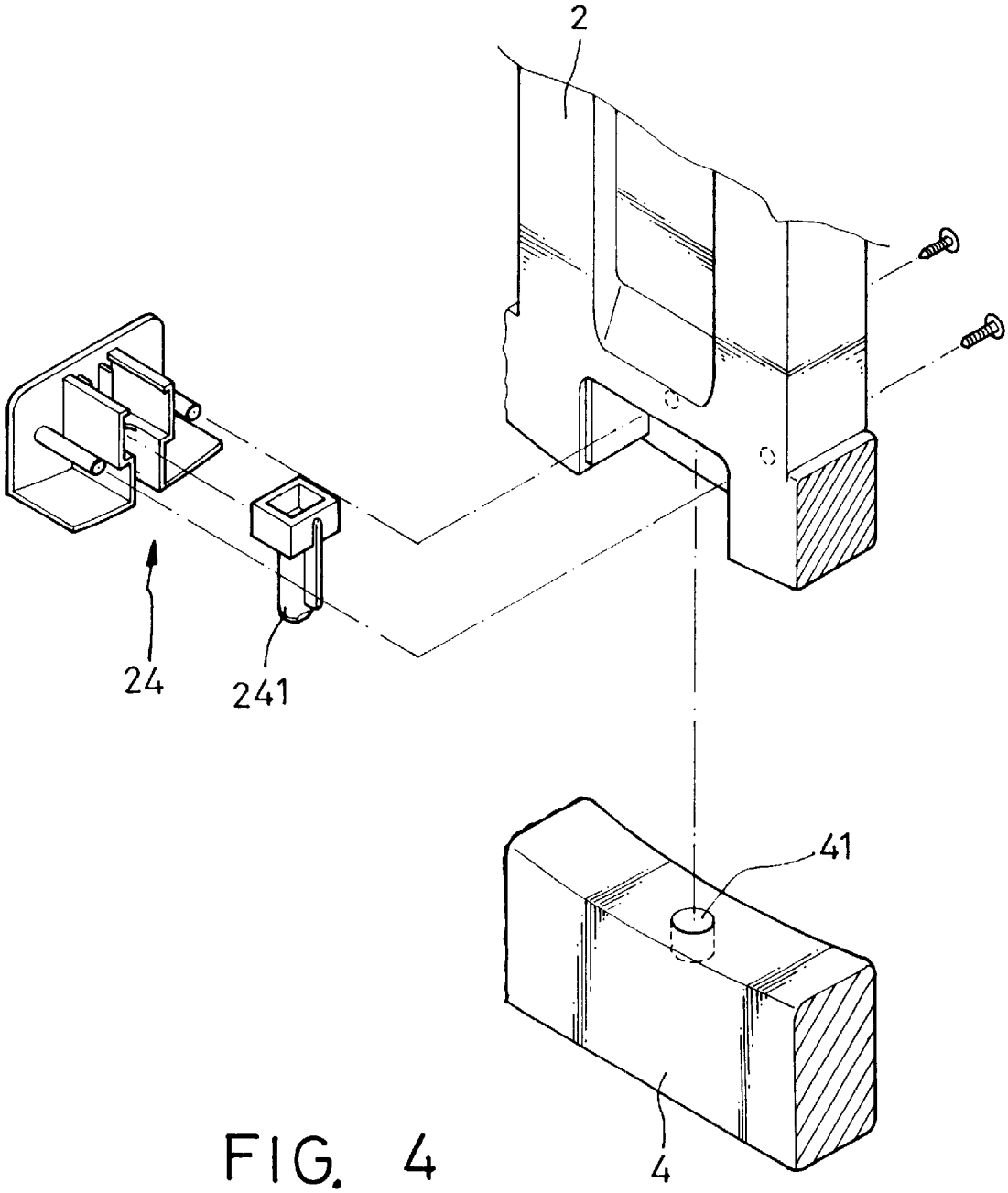
FIG. 4 is a fragmentary perspective view illustrating the barrier body corresponding to a barrier base.

Referring to FIGS. 1 to 4, a safety door barrier according to the present invention is possible to be joined to the door frame A or attached to a wall next to the doorway in a building, and comprises a barrier post 1, a barrier body 2, a barrier stopper 3 and a barrier base 4. Wherein, the barrier post 1 and the barrier stopper 3 are fixedly mounted, and the barrier post 1 pivotally connects with the barrier body 2. The barrier body 2 ceases motion by way of the barrier stopper 3.

The barrier post 1 provides a size corresponding to the barrier body 2 and in order to enable turning of the barrier body, the barrier post 1 at the upper and the lower ends thereof has upper and lower seats 11, 12 extending inwardly, i.e., extending toward the barrier body 2. The upper seat 11 has an upper stop 111 with an upward slant bottom and has a lower stop 112 with a downward slant top such that the upper seat 111 is opposite to the lower seat 112 to limit up and down movements of the barrier body 2. The lower stop 112 has a lower stop hole 1121 and a lower groove 1122 at the upper end edge thereof. The lower seat 12 at the downward slant top thereof has a lower seat hole 121 and a lower seat groove 122 such that the lower seat hole 121 communicates with the lower seat groove 122. The lower stop hole 1121 and the lower seat hole 121 are provided for pivotally connecting with the barrier body 2.

The barrier body 2 can be a shape of flat plate or a shape with grates as shown in FIG. 1, and provides an upper projection 21 and a lower projection 22 corresponding to the lower stop 112 and the lower seat 12 respectively. Further, an upper pivot 211 and a lower pivot 221 extend downward respectively corresponding to the lower stop hole 1121 and the lower seat hole 121 such that the upper pivot 211 and the lower pivot 221 can be inserted into the lower stop hole 1121 and the lower seat hole 121 in a state of being turned freely. Besides, an upper tenon 212 and a lower tenon 222 provided on the barrier body 2 have a size slightly less than the lower stop groove 1122 and the lower seat groove 122 so that the upper tenon 212 and the lower tenon 222 can engage with the lower stop groove 1122 and the lower seat groove 122 respectively.

A recess is provided at an upper lateral side opposite to the upper projection 21 and a lock 23 is located at the recess. The lock 23 has a conventional rotary lock 231 known in the art so that no detail will be described further. The lock 23 includes an automatic latch device 232, which is different from the prior art and is composed of a latch 2321 and a spring 2322, so that the latch 2321 may retreat inward during being pressed and protrude outward during being free from the pressed force. In addition, a gravity lock 24 is mounted at the bottom of the barrier body 2 and a lock pin 241 of the gravity lock 24 moves in a space in a way of hanging downward due to the force of gravity.

The barrier stopper 3 has a stop head 31 extending outward with a lock hole 311 so as to receive a lock pin of the rotary lock 231 as soon as the rotary lock 231 is turned and the lock pin moves outward. Besides, a T-shaped latch hole 32 is provided in the stop head 31 corresponding to the latch 2321 to receive the latch 2321 while the latch. device 232 is in operation.

The barrier base 4 may be fixedly joined to the barrier post I and the barrier stopper 3 so that the barrier body 2 can be turned with respect to the barrier base 4 too. A pinhole 41 is provided in the barrier base 4 corresponding to the lock pin 241 for receiving the lock pin 241 while the gravity lock is in operation.

Referring to FIGS. 1 to 4 again, once the safety door barrier is in use, the upper and the lower pivots 211, 221 of the barrier 2 are inserted into the lower stop hole 1121 and the lower seat hole 121 respectively. While the safety door barrier is disposed at the closed position, both the upper and the lower tenons 212, 222 fall into the lower stop groove 1122 and the lower seat groove 122 respectively to constitute a state of being located. The latch 2321 of the barrier body 2 is pushed outward by a spring force and moves into a generally vertically extending portion of the latch hole of the barrier stopper 3, and the lock pin 241 moves downward to engage with the pinhole 41. At this time, the rotary lock 231 can be turned to pierce into the lock hole 311 of the barrier stopper 3 so as to form a state of locking in case of a further lock being required.

In case of the safety door barrier being needed to open, the rotary lock 231 is released first and then the barrier body 2 is pulled upward with the upper pivot 211 and the lower pivot 221. At this time, the barrier body 2 can be opened by way of being pushed with respect to the upper and the lower pivots 211, 221. Next, the barrier body 2 is put down and slides downward such that the upper and the lower tenons 212, 222 engage with the lower stop groove 1122 and the lower seat groove 122 respectively. Further, the lock pin 241 enters the pinhole 41 in the barrier base 4 too, and the latch 2321 of the barrier body 2 is inserted into the latch hole 32 in the barrier stopper 3 so that it forms multiple point locations to keep the barrier body 2 out of swinging back and forth. If the safety door barrier is to be locked, simply turn the rotary lock 231 to engage with the stop hole 311 so that the safety door barrier is in a state of being locked.

Accordingly, the advantages of the present invention can be summarized hereinafter:

(1) It is possible for the barrier body to be opened forward or backward instead of being opened in a single direction done by the conventional barrier so that there are more choices for the user and it is more flexible during mounting the safety door barrier to be compatible with various doorframes of buildings.

(2) It is possible for the barrier body to stay in a state of closing automatically instead of the barrier body with the conventional hinge having to swing a little while before staying in a state of closing so that the safety door barrier of the present invention can executes a movement of opening and a movement of closing definitely without any vagueness.

(3) The safety door barrier of the present invention provides a function of natural positioning and it is not easy to be opened unless the barrier body is raised. The feature is much helpful to prevent from being opened by a baby or a pet.

While the invention has been described with reference to preferred embodiment thereof, it is to be understood that modifications or variations may be easily made without departing from the spirit of this invention, which is defined in the appended claims.

What is claimed is:

1. A safety door barrier, comprising:

a barrier post having an elongated shape with upper and lower ends, with upper and lower seats at the upper and lower ends respectively, the upper seat having an upper stop with an upwardly slanted bottom and a lower stop with a downwardly slanted top, the lower stop having a lower stop hole, and the lower seat at a top thereof having a lower seat hole;

a barrier body having a height corresponding to a height of the barrier post, the barrier body having upper and lower projections corresponding to the lower stop and the lower seat respectively, an upper pivot and a lower pivot extending downwardly from the upper and the lower projections and engaging the lower stop hole and the lower seat hole, respectively, so as to pivotally attach the barrier body to the barrier post such that the barrier body is vertically and pivotally movable relative to the barrier post between a closed position and an open position;

an elongated stopper having a height corresponding to the height of the barrier body and being located adjacent to the barrier body, the stopper having a stop head with a lock hole and a T-shaped latch hole;

a manually operated lock on the barrier body and operable so as to engage and disengage the lock hole in the stopper; and, an automatic latch device on the barrier body including a protruding latch member, the latch member only engaging a generally vertically extending portion of the latch hole in the stopper when the barrier body is in the closed position so as to prevent pivoting of the barrier body relative to the barrier post, and disengaging the latch hole when the barrier body is moved to the open position thereby permitting pivoting of the barrier body relative to the barrier post.

2. The safety door barrier according to claim 1, wherein the lower stop includes a lower stop groove and the top of the lower seat includes a lower seat groove, and further comprising an upper tenon and a lower tenon on the barrier body engaging the lower stop groove and the lower seat groove respectively when the barrier body is in the closed position.

3. The safety door barrier according to claim 1 further comprising:

a) a barrier base located below the barrier body, the barrier base including a pinhole; and b) a lock pin mounted on the barrier body and protruding from the barrier body so as to engage the pinhole when the barrier body is in the closed position to thereby prevent pivoting movement of the barrier body relative to the barrier post.

* * * * *